US007518567B2

(12) United States Patent
Utagawa et al.

(10) Patent No.: US 7,518,567 B2
(45) Date of Patent: Apr. 14, 2009

(54) PLANAR ANTENNA

(75) Inventors: Naoaki Utagawa, Gunma (JP); Katsumi Chigira, Gunma (JP); Takeshi Sampo, Gunma (JP); Takashi Nozaki, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 35 days.

(21) Appl. No.: 11/655,891

(22) Filed: Jan. 22, 2007

(65) Prior Publication Data

US 2007/0171132 A1 Jul. 26, 2007

(30) Foreign Application Priority Data

Jan. 23, 2006 (JP) ..... 2006-013684
Jan. 19, 2007 (JP) ..... 2007-010047

(51) Int. Cl.
*H01Q 1/38* (2006.01)

(52) U.S. Cl. ..... 343/846; 343/700 MS

(58) Field of Classification Search ..... 343/700 MS, 343/829, 830, 846
See application file for complete search history.

(56) References Cited

U.S. PATENT DOCUMENTS 6,429,828 B1 * 8/2002 Tinaphong et al. ..... 343/824
6,762,729 B2 * 7/2004 Egashira ..... 343/767
2002/0003499 A1 1/2002 Kouam et al.

FOREIGN PATENT DOCUMENTS

| | | |
|---|---|---|
| EP | 1 172 885 | 1/2002 |
| JP | 5-136625 | 6/1993 |
| WO | 01/18910 | 3/2001 |
| WO | 2005/064745 | 7/2005 |

* cited by examiner

*Primary Examiner*—Michael C Wimer
(74) *Attorney, Agent, or Firm*—Morgan, Lewis & Bockius LLP

(57) ABSTRACT

In a planar antenna, a plate member is adapted to be electrically grounded. A radiating electrode is opposing the plate member with a gap and extending parallel to the plate member. A feeding pin is disposed at a center part of the radiating electrode, and adapted to feed power to the radiating electrode. At least one pair of short pins is electrically connecting the plate member and an outer edge of the radiating electrode at symmetrical positions relative to the feeding pin. The radiating electrode is formed with blank portions which are located at such positions that are on hypothetical straight lines connecting the feeding pin and the short pins.

20 Claims, 17 Drawing Sheets

1 : 830MHz VSWR 2.88
2 : 885MHz VSWR 3.76
3 : 1940MHz VSWR 2.11
2 : 2150MHz VSWR 2.46

1 : 830MHz VSWR 1.84
2 : 885MHz VSWR 2.37
3 : 1940MHz VSWR 3.19
4 : 2150MHz VSWR 3.60

PLANAR ANTENNA

BACKGROUND

The present invention relates to a planar antenna that is small in size and low profile.

As a conventional planar antenna having a small size and low profile, an M-type antenna having a flat radiating electrode is disclosed in Japanese Patent Publication No. 5-136625A, which will be described with reference to FIGS. 35 to 37.

In the conventional M-type antenna as shown in FIG. 35, a radiating electrode 12, which is formed of a flat conductive plate and whose planar outer shape is square, is disposed to be spaced apart from a grounding plate 10 and parallel to the grounding plate 10. A feeding pin 14 is erected from the side of the grounding plate 10 and is electrically connected to an approximate center portion of the radiating electrode 12. In addition, at approximately symmetrical locations relative to the location where the feeding pin 14 is disposed, a pair of short pins 16 are provided such that center locations of outer edge portions of two opposing sides of the radiating electrode 12 are electrically connected to the grounding plate 10. The feeding pin 14 is electrically isolated from the grounding plate 10. In a case where a length of one side of the radiating electrode 12 is set to 84 mm and the height of one side of the radiating electrode 12 from the grounding plate 10 is set to 25 mm, a resonance frequency of about 900 MHz is obtained, as shown in FIG. 36. Further, in a case where the length of one side of the radiating electrode 12 is set to 84 mm and the height of one side of the radiating electrode 12 from the grounding plate 10 is set to 31 mm, a resonance frequency of 885 MHz is obtained, as shown in FIG. 37. The frequency of 885 MHz is a center frequency for the PDC 800 MHz band that is one of frequency bands used in cellular phones.

As described above, in the conventional M-type antenna, when the height by which the radiating electrode 12 is spaced apart from the grounding plate 10 is increased, a resonance frequency is decreased. As the result of simulation of current distribution of the M-type antenna, it could be understood that a current rarely flows at the sides where the short pins 16 of the radiating electrode 12 are not provided, while a large amount of current flows through the feeding pin 14 and the short pins 16 so as to resonate in a common mode. Accordingly, in a case where the height by which the radiating electrode 12 is spaced apart from the grounding plate 10 is increased, lengths of the feeding pin 14 and the short pins 16 are increased. As a result, a current path length is increased, and a resonance frequency is decreased.

However, in order to decrease the resonance frequency, the height by which the radiating electrode 12 is spaced apart from the grounding plate 10 should be increased. In a case where such an antenna is incorporated in a casing of an electronic apparatus where a small size and low profile is required, there is a drawback in that the height of the electronic apparatus is increased. Accordingly, it is required in achieving the small size and low profile of the antenna with low resonance frequency, without increasing the height by which the radiating electrode 12 is spaced apart from the grounding plate 10, and without expanding a planar shape of the radiating electrode 12.

Further, in recent years, an electronic apparatus has various functions that make users various media or services available. For this reason, a plurality of antennas may be needed, but an installation space of the antennas is generally restricted. When a separate antenna is additionally mounted in the conventional M-type antenna, the additional antenna is provided aside the radiating electrode 12 or on the radiating electrode 12. As a result, the large installation space is needed or the height is increased. Even when the plurality of antennas need to be provided, it is preferable that the arrangement space be as small as possible and the height be as low as possible.

SUMMARY

It is therefore one advantageous aspect of the invention to provide a planar antenna that is capable of decreasing a resonance frequency using an M-type antenna as a basic structure without increasing a height by which a radiating electrode is spaced apart from a grounding plate and without expanding a planar shape of the radiating electrode.

It is also one advantageous aspect of the invention to provide a planar antenna that is capable of disposing an additional antenna without increasing an arrangement space.

According to one aspect of the invention, there is provided a planar antenna, comprising:

a plate member, adapted to be electrically grounded;

a radiating electrode, opposing the plate member with a gap and extending parallel to the plate member;

a feeding pin, disposed at a center part of the radiating electrode, and adapted to feed power to the radiating electrode; and at least one pair of short pins, electrically connecting the plate member and an outer edge of the radiating electrode at symmetrical positions relative to the feeding pin, wherein the radiating electrode is formed with blank portions which are located at such positions that are on hypothetical straight lines connecting the feeding pin and the short pins.

With this configuration, a current path length between the feeding pin and the short pins is increased more than the distance coupled by the hypothetical straight line. As a result, the resonance frequency can be decreased without increasing the height by which the radiating electrode is spaced apart from the grounding plate and without expanding a planar shape of the radiating electrode.

In a case where only one pair of short pins is provided, the resonance frequency can be decreased, as compared with a case where two pairs of short pins are provided.

The radiation electrode may be a square conductive plate formed with four triangular blank portions. One of vertexes of each of the triangular blank portions may oppose the feeding pin and the other vertexes thereof may oppose corners of the square conductive plate. The short pins may be disposed on intermediate portions of two opposing sides of the square conductive plate.

The radiation electrode may be a circular conductive plate formed with four fan-shaped blank portions. A vertex of each of the fan-shaped blank portions may oppose the feeding pin and an arcuate portion thereof opposes an outer periphery of the circular conductive plate. The short pins may be disposed on positions opposing arcuate portions of opposing ones of the fan-shaped blank portions.

With the above configurations, since the blank portions are almost point-symmetrical relative to the center portion of the radiating electrode where the feeding pin is disposed, non-directivity in a horizontal direction can be obtained.

The planar antenna may further comprise an additional antenna disposed on the plate member so as to oppose one of the blank portions.

With this configuration, the space can be efficiently used, and even when an additional antenna is incorporated, the installation space and the height of the planar antenna will not increased.

Portions of the radiating electrode defined between the blank portions may be partially cut to form gaps.

In a case where the planar antenna is configured so as to resonate at two frequencies and the gaps are formed at locations where no current is generated in the resonance operation at the higher resonance frequency, the lower resonance frequency is shifted so as to close to the higher resonance frequency because the gaps establish a capacitive coupling. As a result, the band of the high resonance frequency is widened and the gain is increased.

The planar antenna may further comprise chip capacitors, respectively disposed in the gaps.

With this configuration, a coupling capacitance in the gap can be arbitrarily set, and the low resonance frequency can arbitrarily shifted so as to close to the high resonance frequency, which improves the characteristics of the high resonance frequency.

The planar antenna may further comprise chip inductors, respectively disposed in the gaps.

In a case where the planar antenna is configured so as to resonate at two frequencies and the gaps are formed at the locations where the current becomes maximized in the resonance operation at the higher resonance frequency, the chip inductors serve as extension coils, and thus it is possible to obtain an effect of decreasing the higher resonance frequency.

DETAILED DESCRIPTION OF EXEMPLARY EMBODIMENTS

Exemplary embodiments of the invention will be described below in detail with reference to the accompanying drawings.

Figure 1:
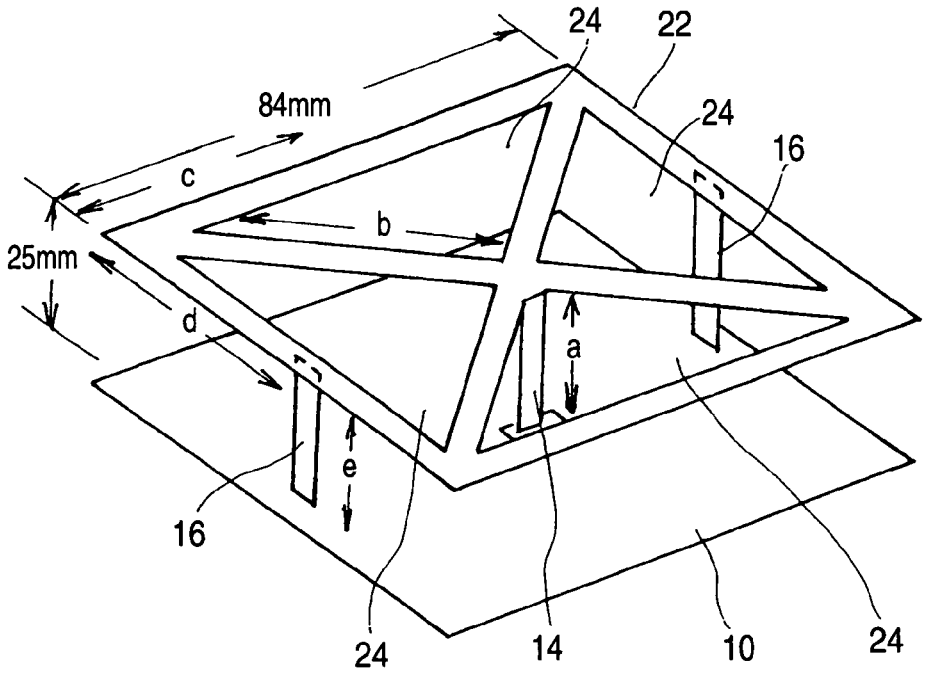
FIG. 1 is a perspective view of a planar antenna according to a first embodiment of the invention.

In a planar antenna according to a first embodiment of the invention shown in FIG. 1, a radiating electrode 22 having a planar outer shape of a square is disposed to be spaced apart from a grounding plate 10 and to be parallel to the grounding plate 10. The radiating electrode plate 22 is formed of a flat member, such as a conductive plate. Notched portions 24, each having an isosceles triangle shape, are provided in the radiating electrode 22. Each of the notched portions 24 has a lower side parallel to each side of the radiating electrode and has a vertex directed to the approximate center portion of the radiating electrode. Accordingly, the radiating electrode includes outer edge portions forming the square peripheries and a cross-shaped portion coupling four corners of the square. Further, a feeding pin 14 is erected from the side of the grounding plate 10 and is electrically connected to the approximate center portion of the radiating electrode 22, that is, a crossing portion of the cross-shaped portion. Further, at the approximate intermediate locations of two opposing sides of the radiating electrode 22, a pair of short pins 16 is disposed to electrically connect the radiating electrode 22 and the grounding plate 10. The feeding pin 14 is electrically isolated from the grounding plate 10.

Figure 2:
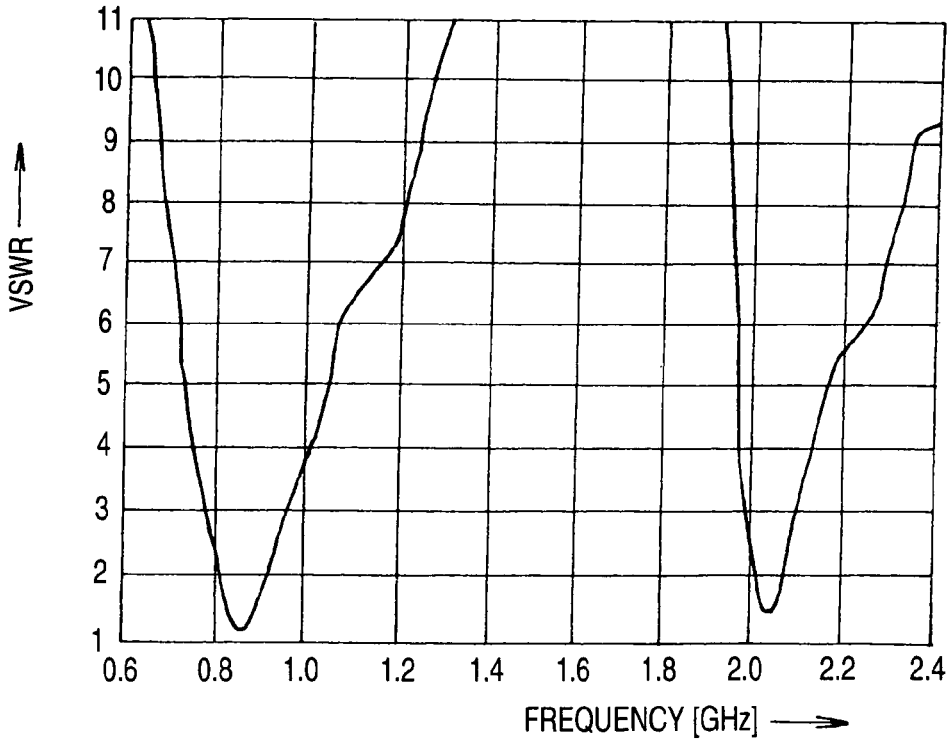
FIG. 2 is a VSWR characteristic graph of the planar antenna of FIG. 1.
Figure 3:
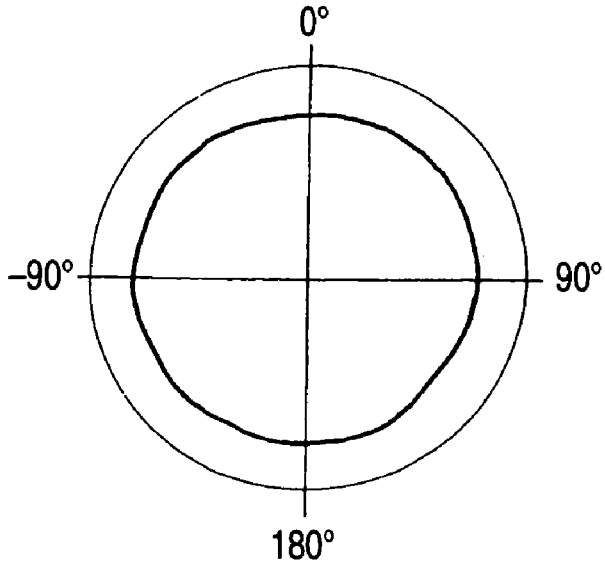
FIG. 3 is a horizontal directivity graph of the planar antenna of FIG. 1.
Figure 35:
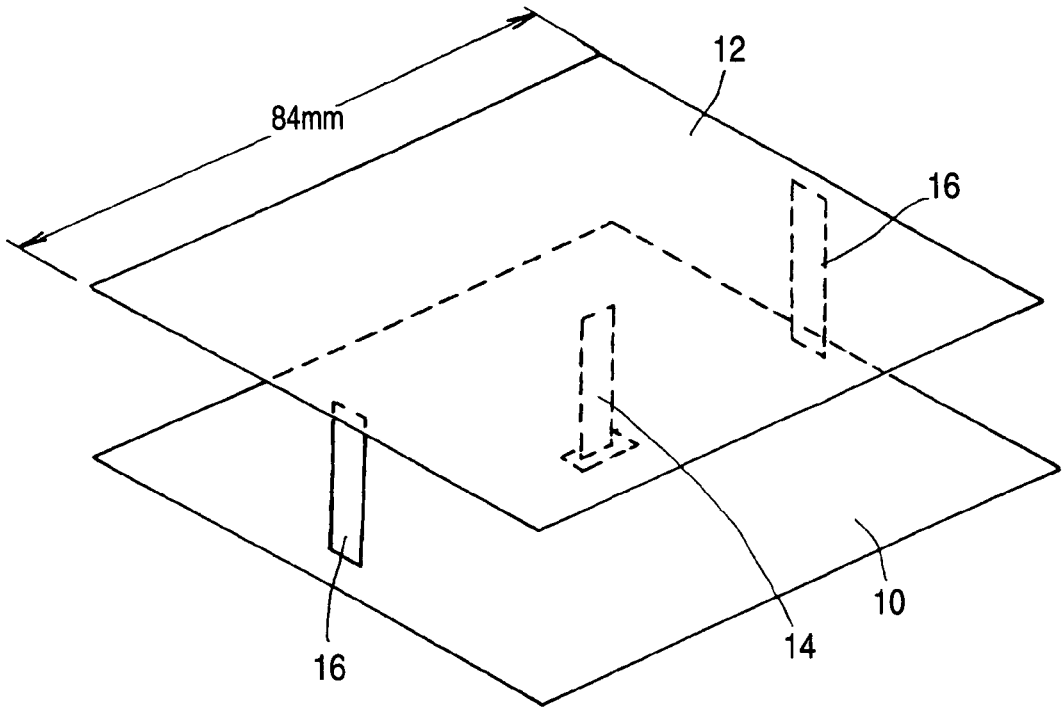
FIG. 35 is a perspective view of a conventional planar antenna.
Figure 36:
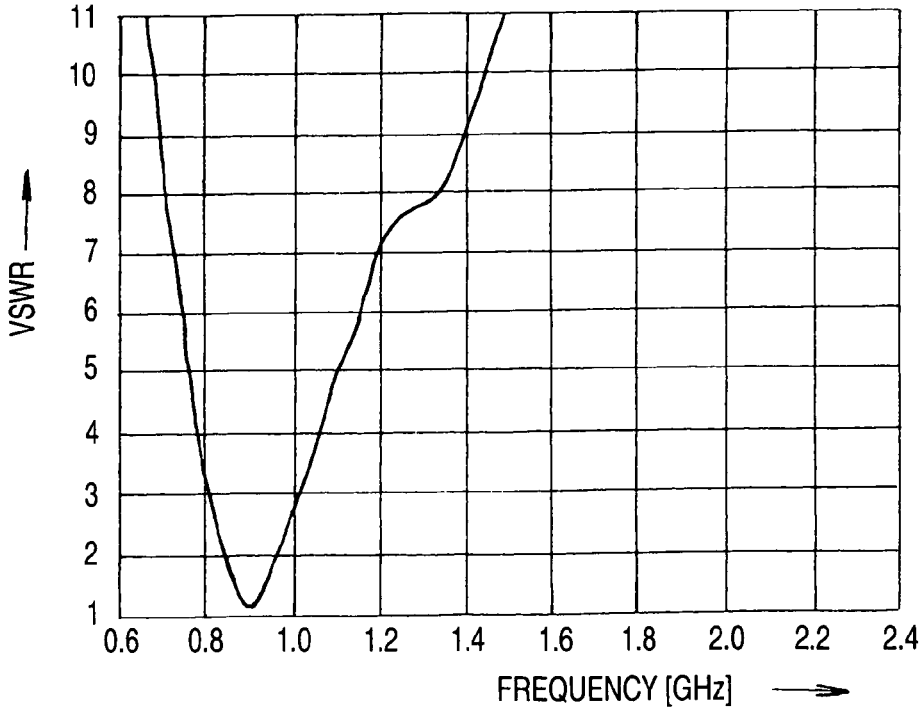
FIG. 36 is a VSWR characteristic graph of the conventional planar antenna.
Figure 37:
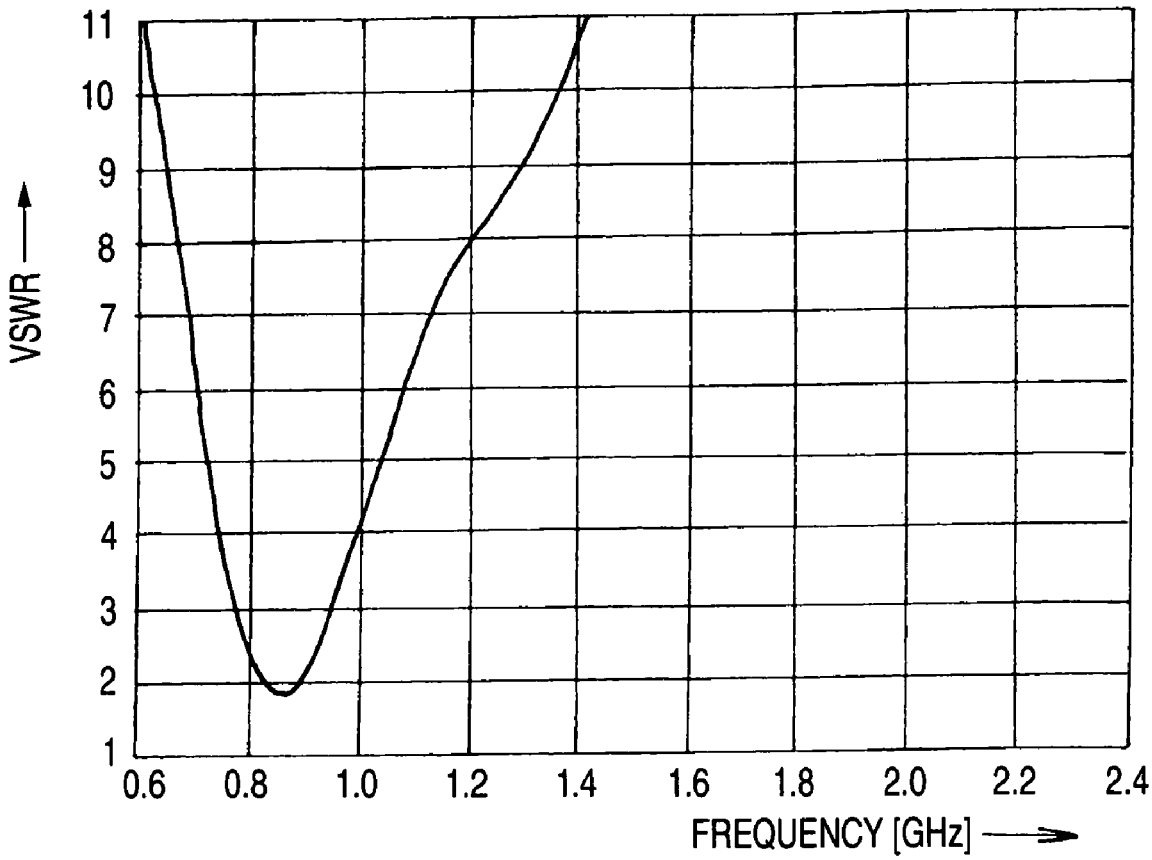
FIG. 37 is a VSWR characteristic graph of a comparative example with respect to the conventional planar antenna.

In this embodiment, a length of one side of the radiating electrode 22 is set to 84 mm and the height by which the one side of the radiating electrode 22 is spaced apart from the grounding plate 10 is set to 25 mm, so that a resonance frequency is 885 MHz, as shown in FIG. 2. As compared with the conventional M-type antenna shown in FIG. 35, there is a difference in that the notched portions 24 are provided and thus a resonance frequency is decreased. Further, as shown in FIG. 3, as the horizontal directivity, almost non-directivity is obtained. Further, a radiating electric field is not generated in a zenith direction. As shown in FIG. 2, in addition to the low resonance frequency of 885 MHz, the high resonance frequency of 2045 MHz is also obtained.

In the first embodiment, in the simulation of the current distribution in the operation at the low resonance frequency of 885 MHz, a current is not generated at the intermediate locations of two opposing sides of the radiating electrode 22 where the short pins 16 are not disposed. Accordingly, it is confirmed that at the resonance frequency of 885 MHz, the planar antenna resonates in a common mode of $\lambda/2$ through a current path having a total length (a+b+2c+d+e) including the length "a" of the feeding pin 14, the length "b" from the center portion of the radiating electrode 22, to which the feeding pin 14 is connected, to the square corner, the reciprocal length of the length "c" from the corner to the intermediate location of the side where the short pin 16 is not connected and the current is not generated, the length "d" from the corner to the intermediate location of the side where the short pin 16 is disposed, and the length "e" of the short pin 16. Therefore, the notched portions 24 are provided in the radiating electrode 22 so as to intercept the straight line coupling the arrangement location of the feeding pin 14 and the arrangement locations of the short pins 16. As compared with the conventional M-type antenna, it should be noted that the current length is elongated, and that even though the height by which the radiating electrode 22 is spaced apart from the grounding plate 10 is not increased due to the lengthening of the current path and the planar shape of the radiating electrode 22 is not expanded, the low resonance frequency can be obtained.

Further, in the simulation of the current distribution in the operation at the high resonance frequency of 2045 MHz in accordance with the first embodiment, the current does not flow at the two opposing sides of the radiating electrode 22 where the short pins 16 are connected, and the current is not generated at the intermediate locations of the facing two sides of the radiating electrode 22 where the short pins 16 are not connected and locations close to the connecting location of the feeding pin 14 at the cross-shaped portion. Accordingly, it is confirmed that at the resonance frequency of 2045 MHz, the planar antenna resonates as a top-load-type antenna of $3\lambda/4$ through a current path having a total length (a+b+c) including the length "a" of the feeding pin 14, the length "b" from the center portion of the radiating electrode 22, to which the feeding pin 14 is connected, to the corner, and the length "c" from the corner to the intermediate location of the side where the short pin 16 is not connected and the current is not generated. In addition, the horizontal directivity is non-directivity, and the radiating electric field not being generated in the zenith direction is the same as in the case of the resonance frequency of 885 MHz.

Figure 4:
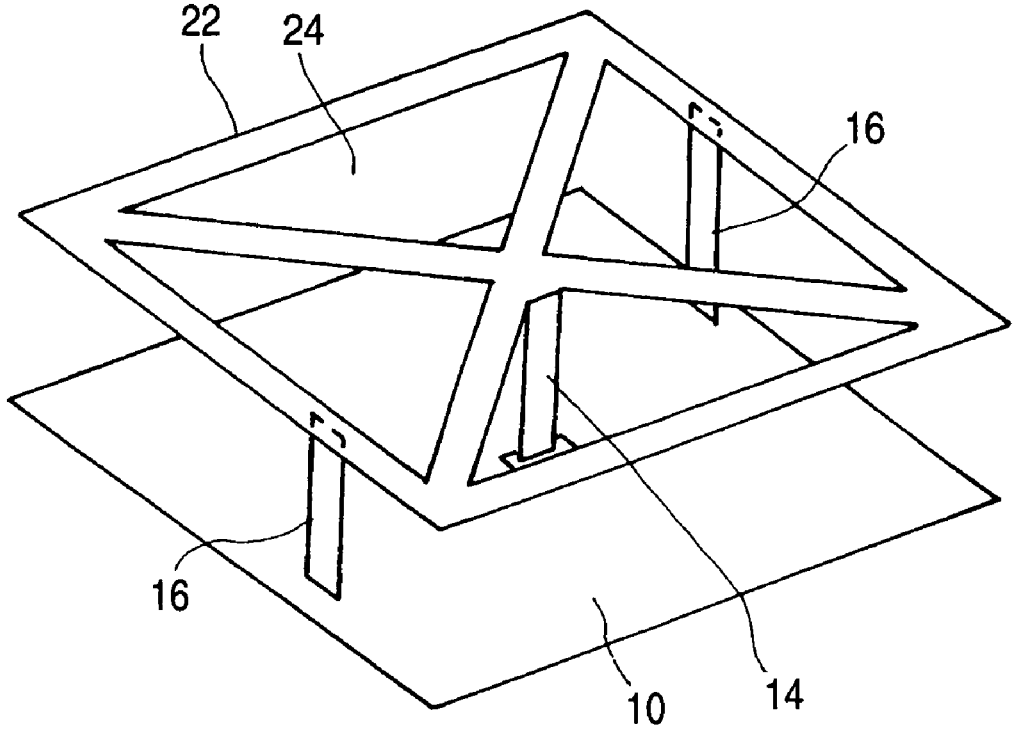
FIG. 4 is a perspective view of a first comparative example with respect to the planar antenna of FIG. 1.
Figure 5:
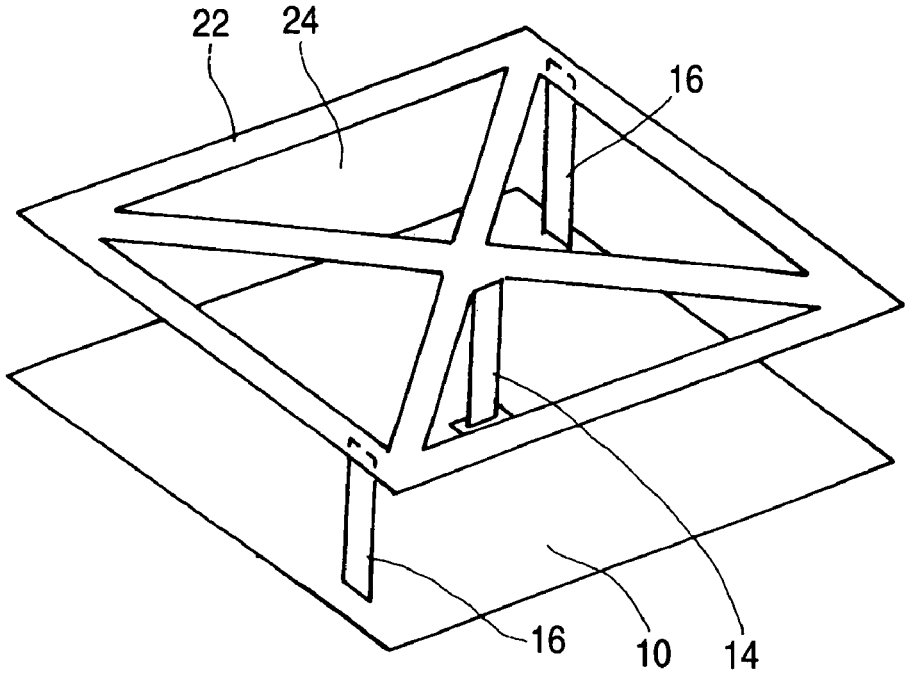
FIG. 5 is a perspective view of a second comparative example with respect to the planar antenna of FIG. 1.

Meanwhile, in order to explain the operation of the above planar antenna, simulations were performed by changing the locations of the short pins 16 as shown in FIGS. 4 and 5. In these comparative examples, the size of the planar outer shape of the radiating electrode 22 and the height by which the radiating electrode 22 was spaced apart from the grounding plate 10 were the same as in the first embodiment. Further, the same members as those shown in FIG. 1 are denoted by the same reference numerals, and the repetitive description will be omitted.

In the first comparative example shown in FIG. 4, the result was obtained in which the lower resonance frequency was increased by about 10 MHz, as compared with that of the first embodiment. Further, in the second comparative example shown in FIG. 5, the result was obtained in which the lower resonance frequency was increased by about 10 MHz, as compared with the first comparative example. Accordingly, it was determined that the lowest resonance frequency is obtained at the intermediate locations of the sides as the arrangement locations of the short pins 16.

Figure 6:
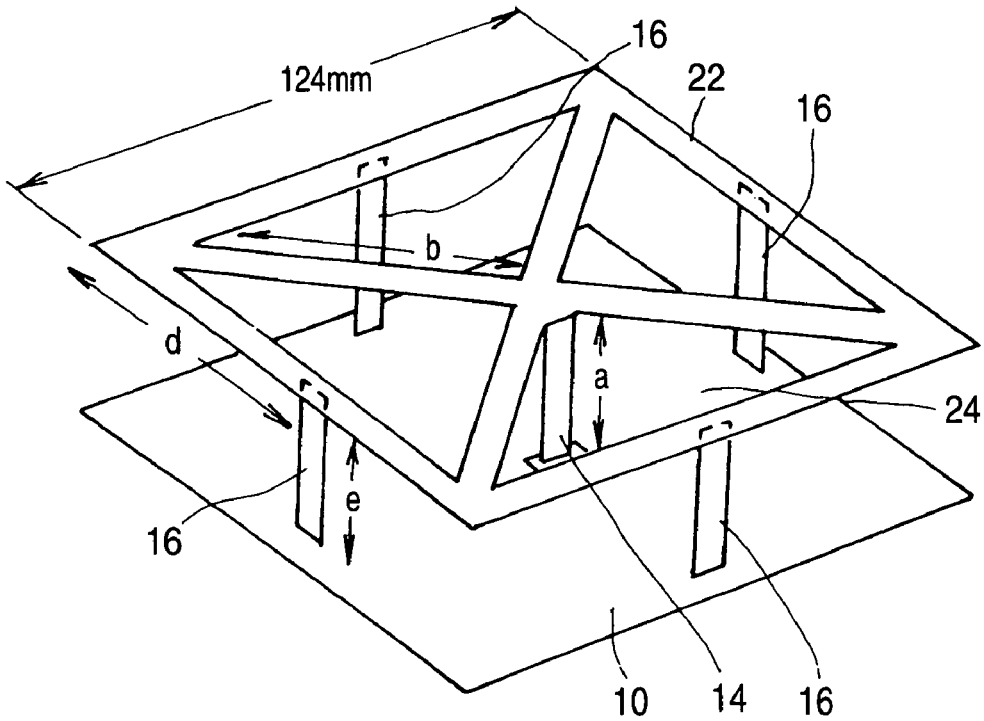
FIG. 6 is a perspective view of a third comparative example with respect to the planar antenna of FIG. 1.

Further, a simulation was performed by providing two pairs of short pins 16 were disposed as shown in FIG. 6. Here, the same members as those shown in FIG. 1 are denoted by the same reference numerals, and the repetitive description will be omitted.

In the third comparative example shown in FIG. 6, the short pins 16, were respectively disposed at the intermediate locations of the four sides of the radiating electrode 22. In a case where the height by which the radiating electrode 22 was spaced apart from the grounding plate 10 was set to 25 mm as in the first embodiment, in order to obtain the resonance frequency of 855 MHz, the length of one side of the radiating electrode plate having the planar outer shape needed to be set to 124 mm, such that it was much larger than that in the first embodiment. The two pairs of short pins 16 were provided and the planar antenna resonated in a common mode of $\lambda/2$ through a current path having a total length (a+b+d+e) including the length "a" of the feeding pin 14, the length "b" from the center portion of the radiating electrode, to which the feeding pin 14 was connected, to the corner, and the length "d" from the corner to the intermediate location of the side where the short pin 16 was disposed, and the length "e" of the short pin 16. In order to obtain the resonance frequency of 885 MHz, the size of the planar outer shape of the square needed to be increased although non-directivity is enhanced.

Figure 7:
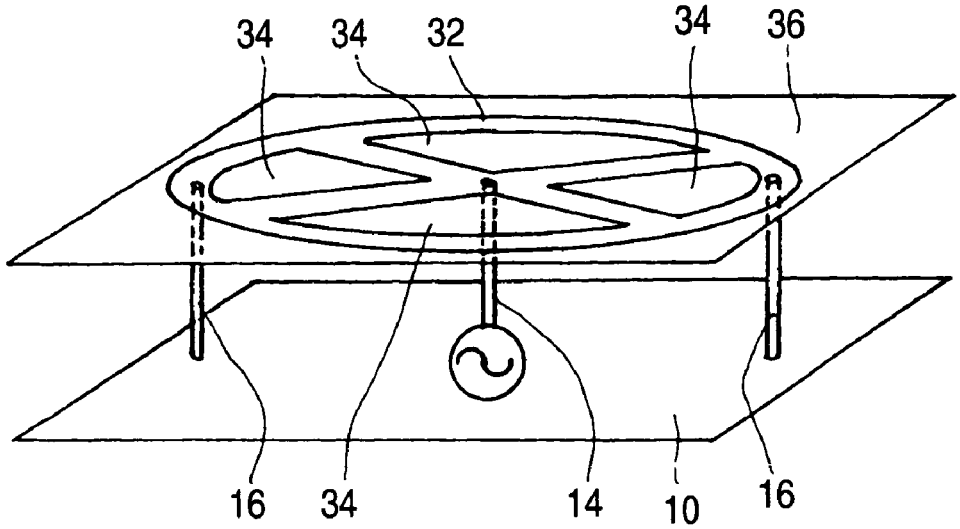
FIG. 7 is a perspective view of a planar antenna according to a second embodiment of the invention.
Figure 8:
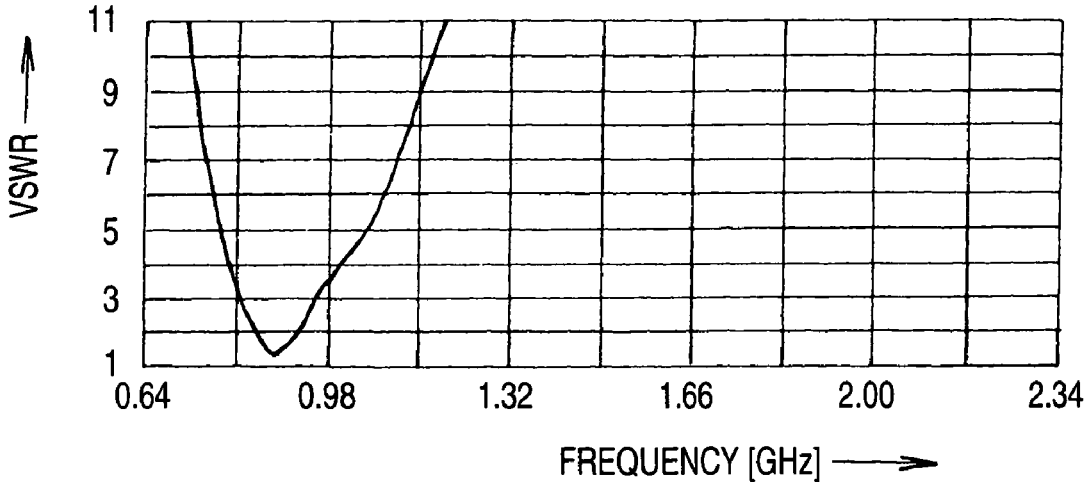
FIG. 8 is a VSWR characteristic graph of the planar antenna of FIG. 7.
Figure 9:
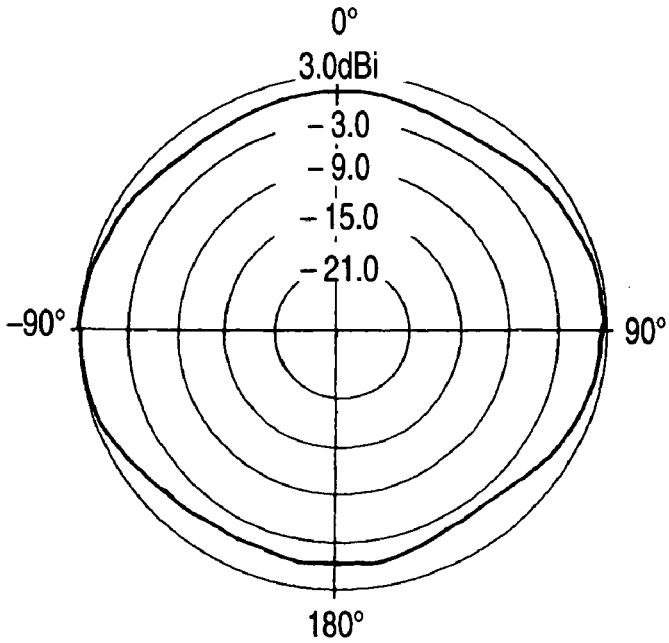
FIG. 9 is a horizontal directivity graph of the planar antenna of FIG. 7.

Next, a second embodiment of the invention will be described with reference to FIGS. 7 to 9. In FIG. 7, the same members as those shown in FIG. 1 are denoted by the same reference numerals, and the repetitive description will be omitted.

In the second embodiment, a radiating electrode 32 having a planar outer shape to be circular and made of a conductive thin film or the like is provided on an insulating resin plate 36, and is disposed to be spaced apart from the grounding plate 10 and to be parallel to the grounding plate 10. In the radiating electrode 32, four fan-shaped notched portions 34 are provided. Each of the notched portions has a vertex angle of 90 degrees at which a vertex is directed toward the center portion of the planar outer shape. Accordingly, the radiating electrode includes an edge portion having a circular outer shape, and a cross-shaped portion. In addition, the feeding pin 14 is electrically connected to the approximate center portion of the planar outer shape, that is, a crossing portion of the cross-shaped portion. At the approximate center location of the edge portion having the circular arc shape that is formed by the two fan-shaped notched portions 34 and 34 opposing each other, each of a pair of short pins 16 is disposed to electrically connect the radiating electrode 32 and the grounding plate 10. In a case where the outer diameter of the radiating electrode 32 is set to 85 mm and the height by which the radiating electrode 32 is spaced apart from the grounding plate 10 is set to 25 mm, as shown in FIG. 8, the resonance frequency of 868 MHz is obtained. As shown in FIG. 9, the horizontal directivity is non-directivity. Namely, the notched portions 34 are provided in the radiating electrode 32 so as to intercept the straight line coupling the arrangement location of the feeding pin 14 and the arrangement locations of the short pins 16. Therefore, an antenna having a smaller size than the conventional M-type antenna can be obtained.

Figure 10:
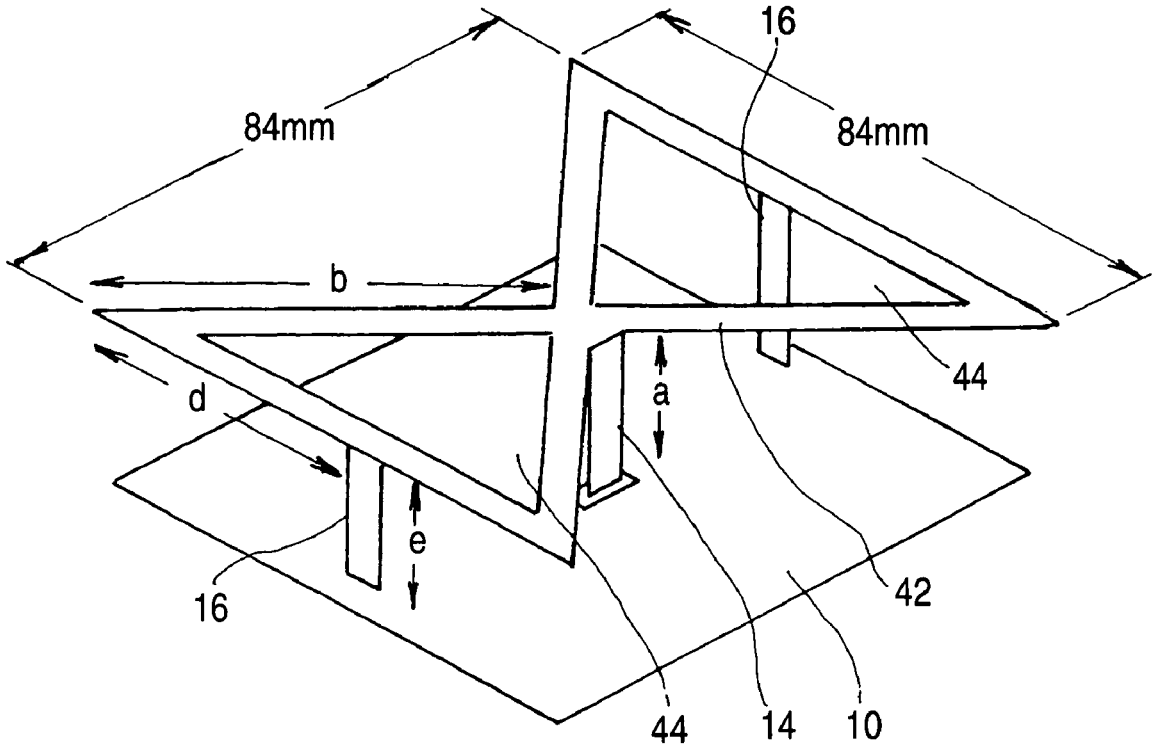
FIG. 10 is a perspective view of a planar antenna according to a third embodiment of the invention.
Figure 11:
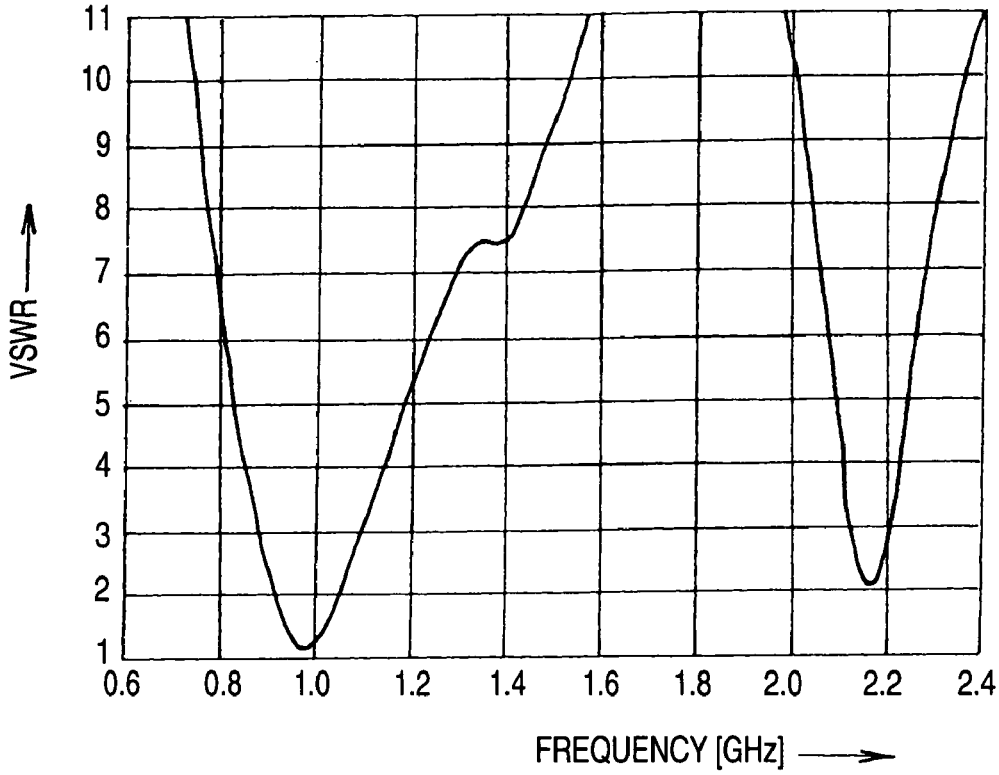
FIG. 11 is a VSWR characteristic graph of the planar antenna of FIG. 10.
Figure 12:
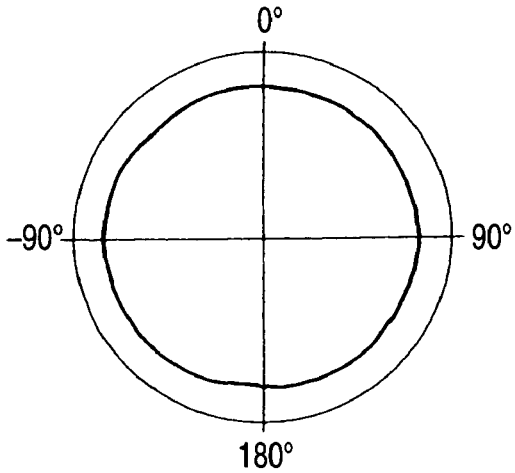
FIG. 12 is a horizontal directivity graph of the planar antenna of FIG. 10.

Next, a third embodiment of the invention will be described with reference to FIGS. 10 to 12. In FIG. 10, the same members as those shown in FIG. 1 are denoted by the same reference numerals, and the repetitive description will be omitted.

In the third embodiment shown in FIG. 10, a radiating electrode 42 is formed by using a flat conductive member. The radiating electrode 42 is provided to be spaced apart from the grounding plate 10 and to be parallel to the grounding plate 10. The radiating electrode 42 has the planar outer shape formed such that vertexes of two isosceles triangles are opposite to each other and the two isosceles triangles are symmetrical, and the bottom sides of the two isosceles triangles are parallel to each other. The length of the bottom side of each triangle is set to 84 mm and the interval between the two parallel bottom sides is set to 84 mm. In addition, in the isosceles triangles, triangular notches 44 are provided. This planar shape is obtained by cutting the two sides of the radiating electrode 22 according to the first embodiment where the short pins 16 of the radiating electrode 22 are not disposed. The height by which the radiating electrode 42 is spaced apart from the grounding plate 10 is set to 25 mm, as in the first embodiment. In addition, at the location of the approximate center portion of the radiating electrode 42 where the vertexes of the two isosceles triangles are opposed to each other, the feeding pin 14 is erected from the side of the grounding plate 10 so as to be electrically connected to the center portion. At the intermediate locations of the bottom sides of the two isosceles triangles, the pair of short pins 16 are disposed so as to electrically connect the radiating electrode 42 and the grounding plate 10. With this configuration, as shown in FIG. 11, the lower resonance frequency of 976 MHz and the higher resonance frequency of 2180 MHz are obtained. The horizontal directivity of the lower resonance frequency of 976 MHz is non-directivity, as shown in FIG. 12.

In the third embodiment, in the simulation of the current distribution in the operation at the resonance frequency of 976 MHz, it is determined that the planar antenna resonates in a common mode of $\lambda/2$ through a current path having a total length (a+b+d+e) including the length "a" of the feeding pin 14, the length "b" from the center portion of the radiating electrode to the triangular corner, the length "d" from the corner to the intermediate location of the bottom side where the short pin 16 is disposed, and the length "e" of the short pin 16.

Further, in the first and third embodiments, each of the radiating electrodes 22 and 42 is formed of a flat conductive member, while, in the second embodiment, the radiating electrode 32 is formed of a conductive thin film. The invention is not limited thereto, but the radiating electrode may be formed of a conductive line, such as a copper electrical wire or a copper rod. In order to form the radiating electrode with the conductive line, instead of providing the notched portions 24, 34, and 44 in the first to third embodiments, the radiating electrode may be formed without providing a conductive line that linearly couples the arrangement location of the feeding pin 14 and the arrangement locations of the short pins 16. A planar antenna according to a fourth embodiment of the invention in which the radiating electrode is formed by using the conductive line will be described with reference to FIG. 13. Here, the same members as those shown in FIG. 1 are denoted by the same reference numerals, and the repetitive description will be omitted.

Figure 13:
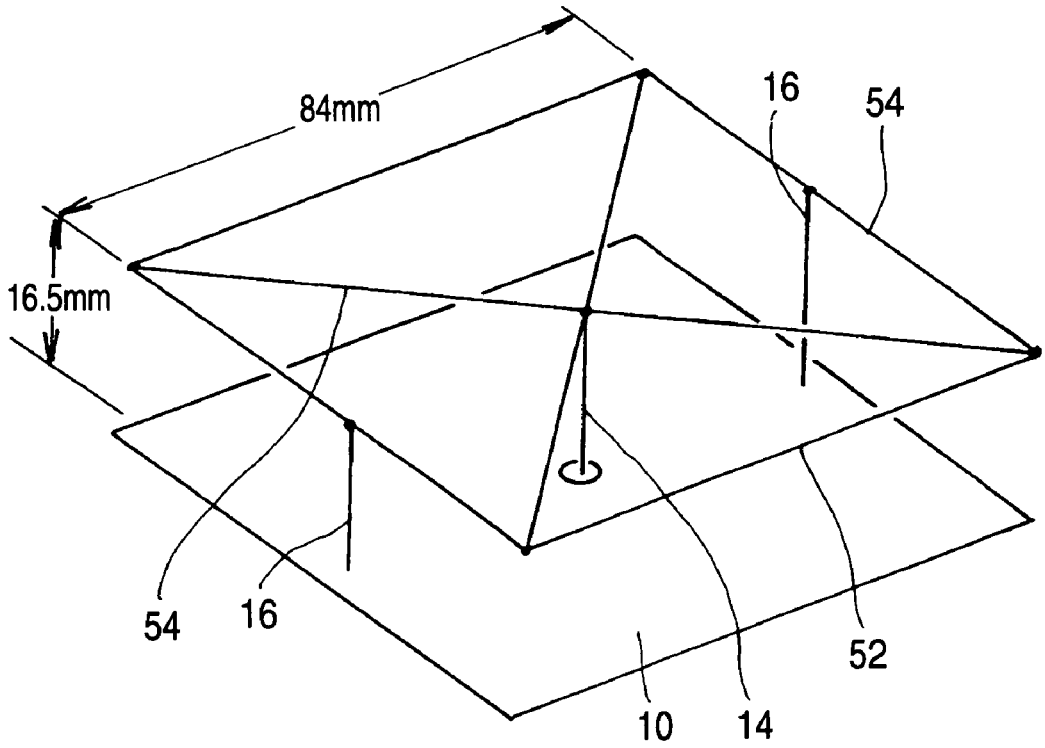
FIG. 13 is a perspective view of a planar antenna according to a fourth embodiment of the invention.

In the fourth embodiment shown in FIG. 13, a radiating electrode 52 is formed of a conductive line 54. The planar shape of the radiating electrode 52 is the same as that of the first embodiment, but its width is very narrower than the width of the radiating electrode that is formed of the flat conductive member. Accordingly, the current path length is substantially increased, and even when the planar size is the same as that of the first embodiment, its height may be set to the height smaller than 16.5 mm. In the fourth embodiment, a narrower band is achieved, as compared with the first embodiment.

Further, the planar shape of the radiating electrodes can be varied shown in FIGS. 14 to 27. In these figures, reference numeral 14 indicates a location where the feeding pin 14 is connected to a radiating electrode 62, reference numeral 16 indicates a location where the short pin 16 is connected to the radiating electrode 62.

Figure 14:
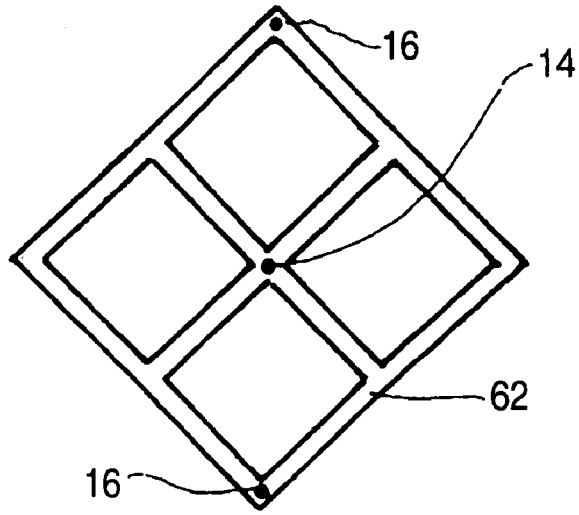
FIG. 14 is a plan view of a radiating electrode of a planar antenna according to a fifth embodiment of the invention.

FIG. 14 shows a fifth embodiment of the invention. In this case, the cross-shaped portion couples the intermediate portions of the respective sides of a square frame portion, the feeding pin 14 is electrically connected to the center portion of the cross-shaped portion, and a pair of short pins 16 are disposed at two diagonal corners of the square frame portion.

Figure 15:
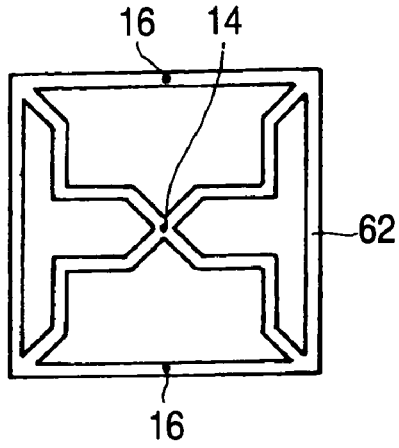
FIG. 15 is a plan view of a radiating electrode of a planar antenna according to a sixth embodiment of the invention.
Figure 16:
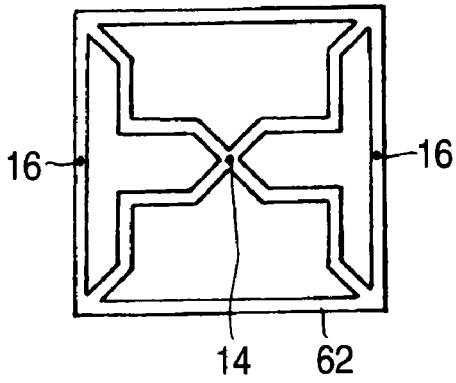
FIG. 16 is a plan view of a radiating electrode of a modified example of the planar antenna of FIG. 15.

FIG. 15 shows a sixth embodiment of the invention. In this case, the length of the radiating electrode is increased by bending each of the arms forming the cross-shaped portion shown in FIG. 1. As shown in FIG. 16, the short pins 16 may be disposed at sides different from those shown in FIG. 15.

Figure 17:
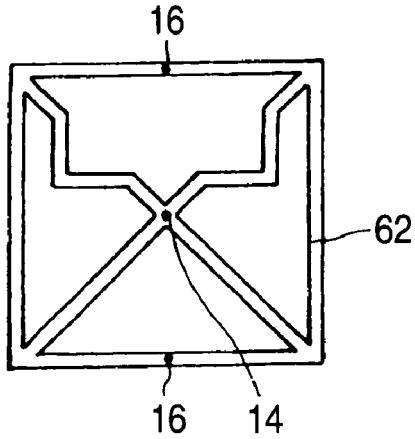
FIG. 17 is a plan view of a radiating electrode of a planar antenna according to a seventh embodiment of the invention.
Figure 18:
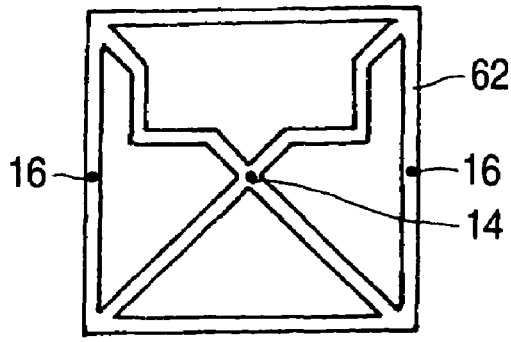
FIG. 18 is a plan view of a radiating electrode of a modified example of the planar antenna of FIG. 17.

FIG. 17 shows a seventh embodiment of the invention. In this case, the length of the radiating electrode is increased by bending some of the arms forming the cross-shaped portion and the others are not bent. As shown in FIG. 18, the short pins 16 may be disposed at sides different from those shown in FIG. 17.

Figure 19:
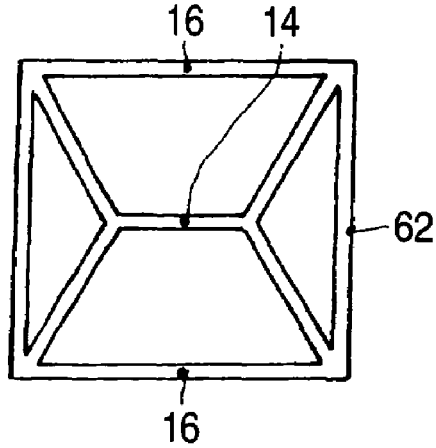
FIG. 19 is a plan view of a radiating electrode of a planar antenna according to an eighth embodiment of the invention.
Figure 20:
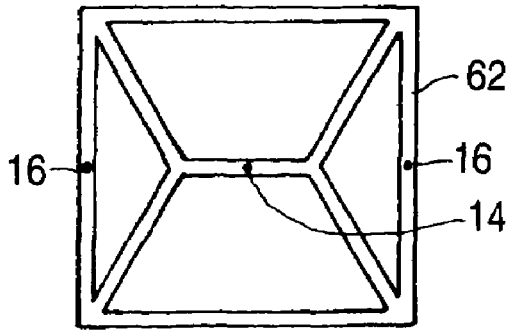
FIG. 20 is a plan view of a radiating electrode of a modified example of the planar antenna of FIG. 19.

FIG. 19 shows an eighth embodiment of the invention. In this case, the center part of a radiation electrode 62 is formed by a single linear portion and both ends of the linear portion are branched and coupled to the respective corners of a square frame portion. As shown in FIG. 20, the short pins 16 may be disposed at sides different from those shown in FIG. 19.

Figure 21:
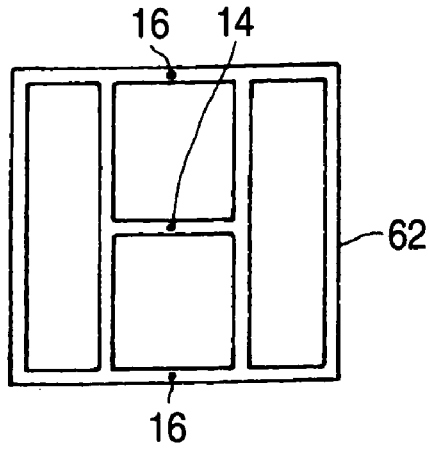
FIG. 21 is a plan view of a radiating electrode of a planar antenna according to a ninth embodiment of the invention.
Figure 22:
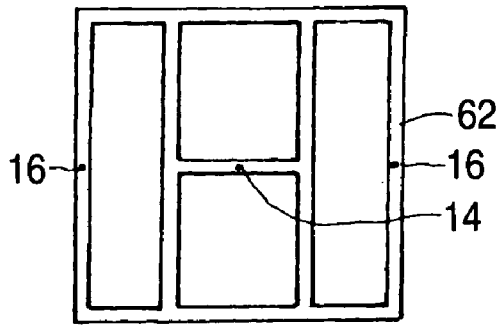
FIG. 22 is a plan view of a radiating electrode of a modified example of the planar antenna of FIG. 21.

FIG. 21 shows a ninth embodiment of the invention. In this case, the center part of a radiation electrode 62 is formed by a single linear portion and both ends of the linear portion are branched and coupled to two sides of a square frame portions where the short pins 16 are provided, thereby forming an H-shaped portion. As shown in FIG. 22, the short pins 16 may be disposed at sides different from those shown in FIG. 21.

Figure 23:
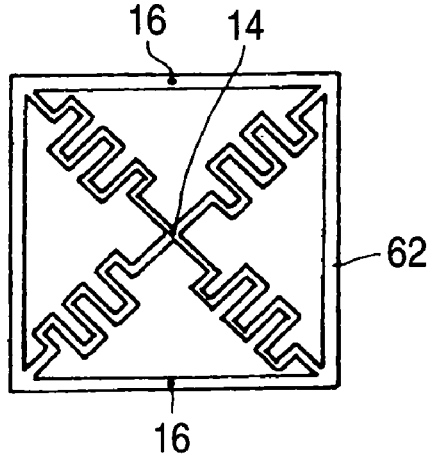
FIG. 23 is a plan view of a radiating electrode of a planar antenna according to a tenth embodiment of the invention.

FIG. 23 shows a tenth embodiment of the invention. In this case, each of the arms forming the cross-shaped portion shown in FIG. 1 is bent in a meandering manner, so that its length is increased.

Figure 24:
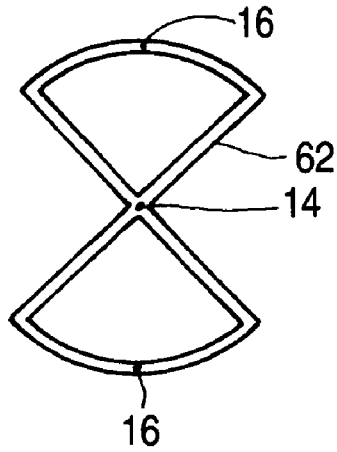
FIG. 24 is a plan view of a radiating electrode of a planar antenna according to an eleventh embodiment of the invention.

FIG. 24 shows an eleventh embodiment of the invention. In this case, the edge portions of the circular arc shape in the second embodiment shown in FIG. 7 where the short pins 16 are not disposed are removed, that is, the triangular bottom side in the third embodiment shown in FIG. 10 has an arcuate shape becoming convex.

Figure 25:
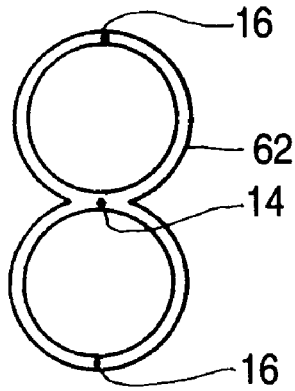
FIG. 25 is a plan view of a radiating electrode of a planar antenna according to a twelfth embodiment of the invention.

FIG. 25 shows a twelfth embodiment of the invention. In this case, the radiating electrode 62 has a shape in which two rings having the same shape are disposed such that portions of the rings come into contact with each other or overlap each other, the feeding pin 14 is disposed at a portion where two rings come into contact with each other, and the short pins 16 are respectively disposed at the other locations of the rings on a line passing through the arrangement location of the feeding pin 14.

Figure 26:
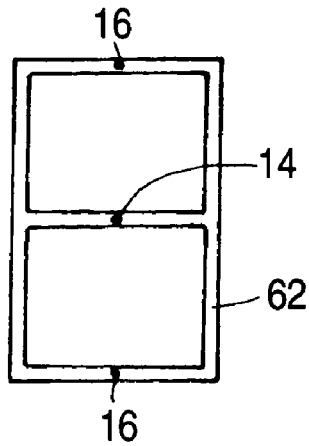
FIG. 26 is a plan view of a radiating electrode of a planar antenna according to a thirteenth embodiment of the invention.

FIG. 26 shows a thirteenth embodiment of the invention. In this case, the radiating electrode 62 has a shape in which two rectangular frames having the same shape are disposed such that portions of the rectangular frames come into contact with each other or overlap each other, the feeding pin 14 is disposed at a portion where two rectangular frames come into contact with each other, and the short pins 16 are respectively disposed at the other locations of the rectangular frames on a line passing through the arrangement location of the feeding pin 14.

Figure 27:
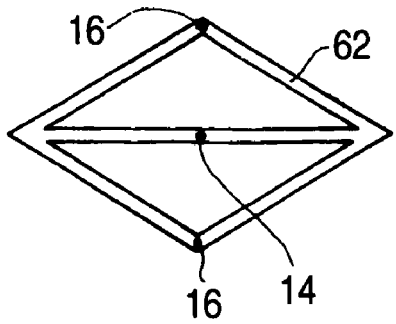
FIG. 27 is a plan view of a radiating electrode of a planar antenna according to a fourteenth embodiment of the invention.

FIG. 27 shows a fourteenth embodiment of the invention. In this case, the radiation electrode 62 has a shape in which two triangular frames having the same shape are disposed such that portions of the triangular frames come in contact with each other or overlap each other, the feeding pin 14 is disposed at a portion where two triangular frames come in contact with each other, and the short pins 16 are respectively disposed at locations corresponding to uncommon apexes of the triangular frames.

Figure 28:
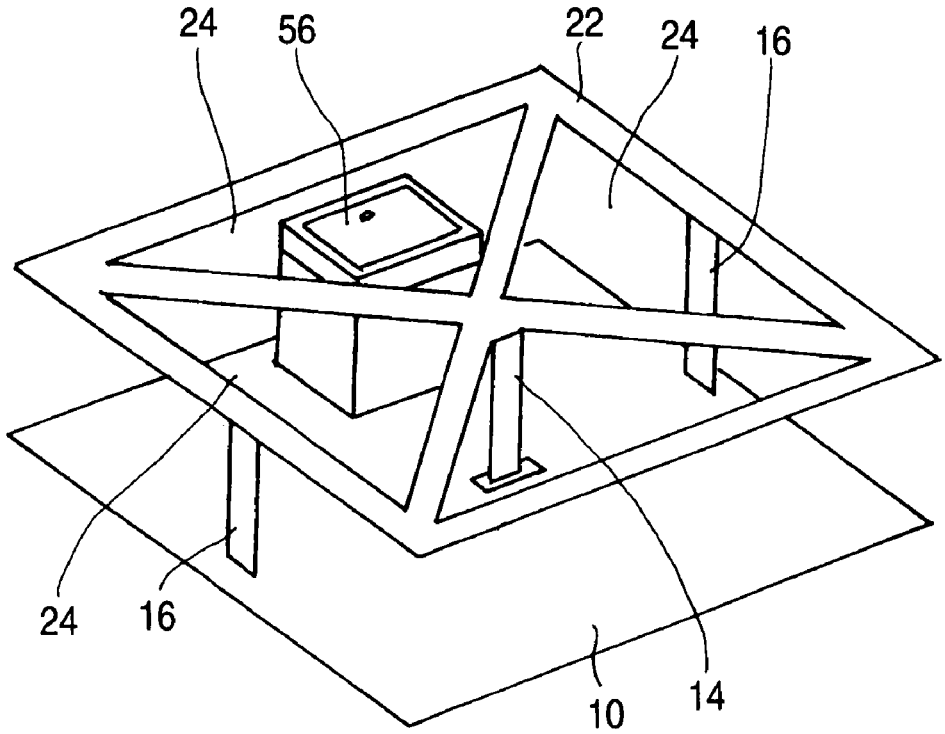
FIG. 28 is a perspective view of a planar antenna according to a fifteenth embodiment of the invention.

Next, a fifteenth embodiment of the invention will be described with reference to FIG. 28. Here, the same members as those shown in FIG. 1 are denoted by the same reference numerals, and the repetitive description will be omitted. In this embodiment, an additional antenna is provided in the notched portion of the radiating electrode or the portion where the conductive line of the radiating electrode is not provided, in the above-described embodiments.

Specifically, the shape of the radiating electrode 22 is the same as that of the first embodiment. In addition, as an example, a GPS patch antenna 56 is disposed on a pedestal in one of the notched portions 24. With this configuration, the space can be effectively used, and the GPS patch antenna 56 is incorporated as an additional antenna. Therefore, the installation space and the height do not need to be increased even in a case where the plurality of antennas are disposed. Further, the additional antenna may be provided at the other portion where the conductive line 54 of the radiating electrode 52 shown in FIG. 13 is not provided or at the portions where the notched portions 34, 44 shown in FIGS. 7 and 10 are formed. Moreover, a further additional antenna may be provided in such positions as required.

Figure 29:
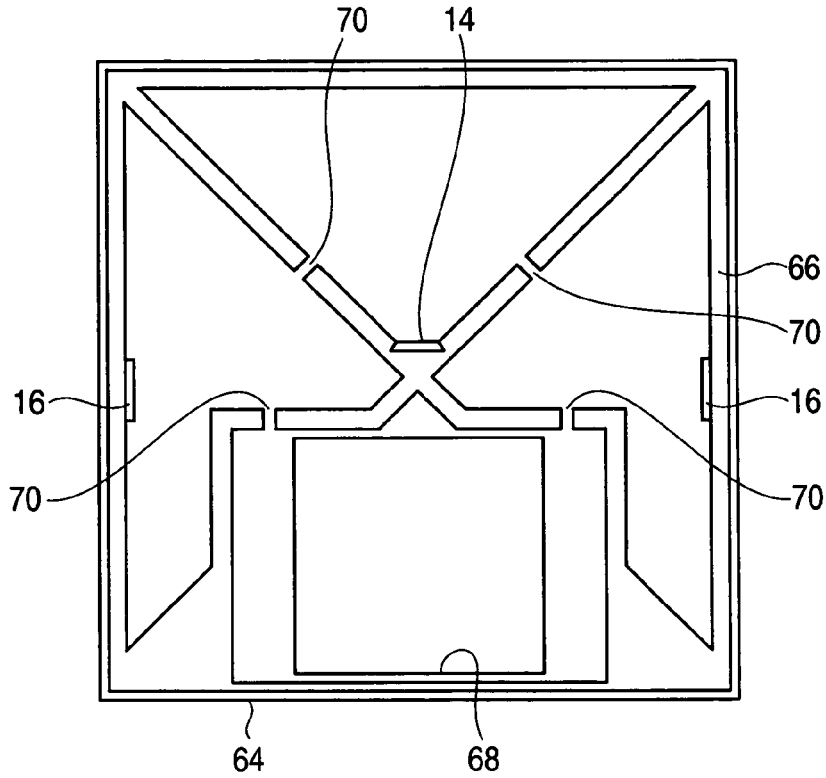
FIG. 29 is a plan view of a planar antenna according to a sixteenth embodiment of the invention.

Next, a sixteenth embodiment of the invention will be described with reference to FIGS. 29 to 31. Here, the same members as those shown in FIG. 1 are denoted by the same reference numerals, and the repetitive description will be omitted. In this embodiment, a radiating electrode 66 formed by a conductive member such as a conductive thin film is provided on an insulative resin plate 64. The radiating electrode 66 includes outer edge portions forming the square peripheries and a cross-shaped portion coupling four corners of the square. Similar to the first embodiment, a feeding pin 14 is electrically connected to an approximate center portion of the radiating electrode 66, that is, a crossing portion of the cross-shaped portion. Further, at the approximate intermediate locations of two opposing sides of the radiating electrode 66, a pair of short pins 16 is disposed. Further, the insulative resin plate 64 is disposed in parallel to a grounding plate 10 in a state where the insulative resin plate is 64 is spaced apart from the grounding plate 10 at a predetermined height. A square hole 68 that is punched in the insulative resin plate 64 is provided to form a space for disposing another antenna. Gaps 70 are formed by cutting the conductive members of the cross-shaped portions between the center portions and the corners of the radiating electrode 66. It is preferable that the locations where the gaps 70 are provided may be approximately the locations where no current is generated in the resonance operation at the high resonance frequency.

With this configuration, the gaps 70 do not affect the high resonance frequency, but affect the low resonance frequency. Specifically, since the locations where the gaps 70 are provided are not the locations where no current is generated in the resonance operation at the low resonance frequency, the capacitive coupling is established, so that the gaps 70 serve as loading capacitors, and the low resonance frequency is shifted so as to close to the high resonance frequency. As a result, the band of the high resonance frequency is widened and the gain is increased.

Figure 30:
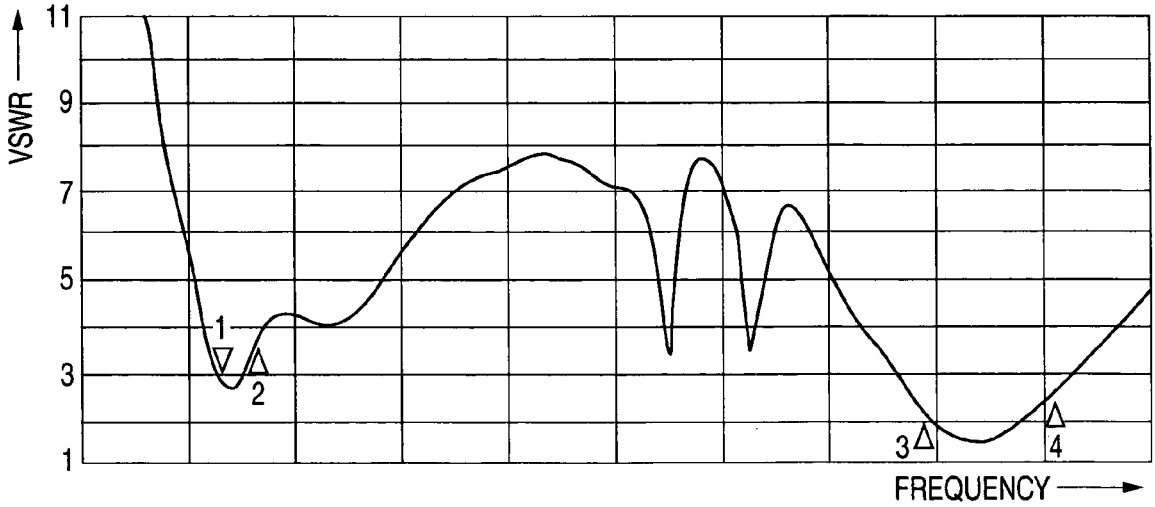
FIG. 30 is a VSWR characteristic graph of the planar antenna of FIG. 29.
Figure 31:
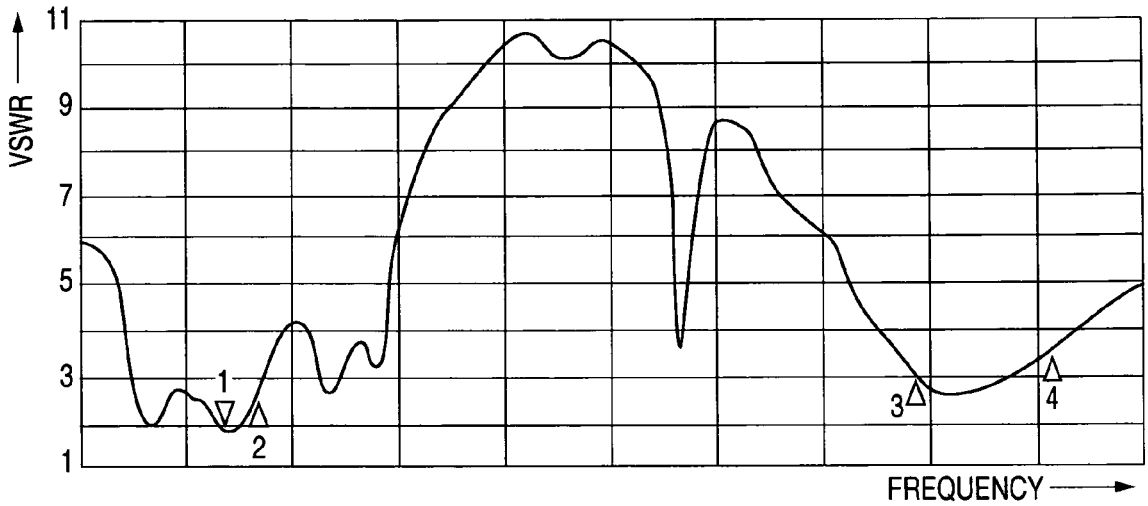
FIG. 31 is a VSWR characteristic graph of a comparative example with respect to the planar antenna of FIG. 29.

This effect is evident as compared FIG. 30 that shows VSWR characteristics of the case where the gaps 70 are provided with FIG. 31 that shows VSWR characteristics of the case where the gaps 70 are not provided. That is, as shown in FIG. 31, VSWR characteristics in the high resonance frequency bands of 1940 MHz and 2150 MHz in the case where the gaps 70 are not provided are 3.19 and 3.60, respectively. On the other hand, as shown in FIG. 30, VSWR characteristics in the high resonance frequency bands of 1940 MHz and 2150 MHz in the case where the gaps 70 are provided are improved to 2.11 and 2.46, respectively, and the bands are widened. Also, in a gain in a horizontal plane, in the bands of the high resonance frequencies of 1940 MHz and 2150 MHz in the case where the gaps 70 are not provided, the respective gains are −5.25 dBi and −5.36 dBi. In the bands of the high resonance frequencies of 1940 MHz and 2150 MHz in the case where the gaps 70 are provided, the respective gains are improved to −2.01 dBi and −2.22 dBi. In this case, when the interval between the gaps 70 is increased, the coupling capacity is decreased, the wavelength reduction effect is increased. Therefore, it is preferable to appropriately set the interval in the gaps.

Figure 32:
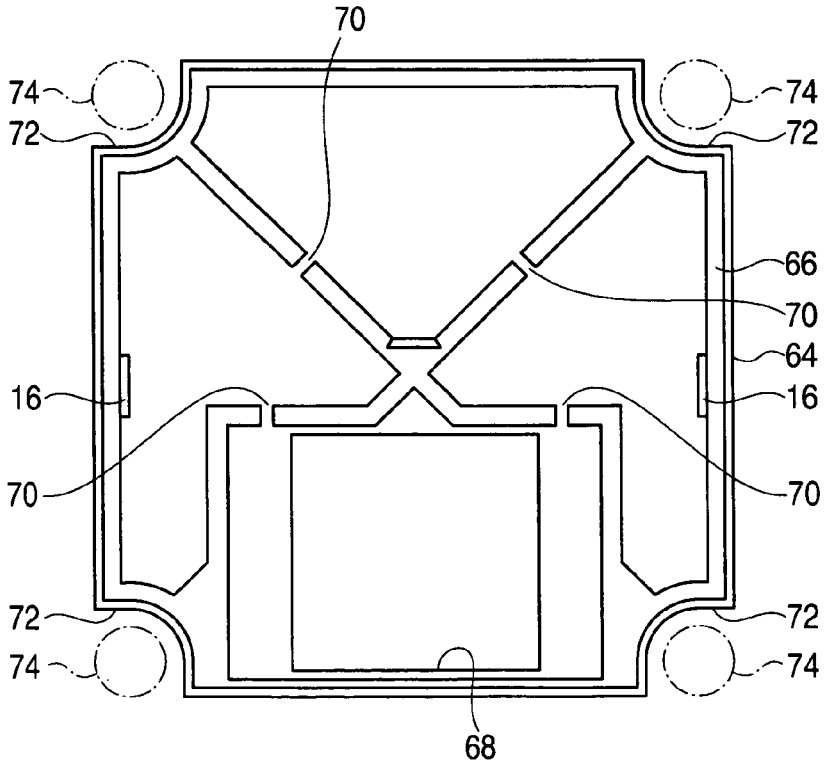
FIG. 32 is a plan view of a planar antenna according to a seventeenth embodiment of the invention.

FIG. 32 shows a seventeenth embodiment of the invention. In this case, arc-shaped notched portions 72 for screws are provided at four corners of the insulative resin plate 64. This embodiment has a structure that avoids mechanical interference with the screws 74 for fixing a radome covering the planar antenna. Therefore, the outer circumferential portion of the radiating electrode 66 is not necessarily square, and may be approximately square.

Figure 33:
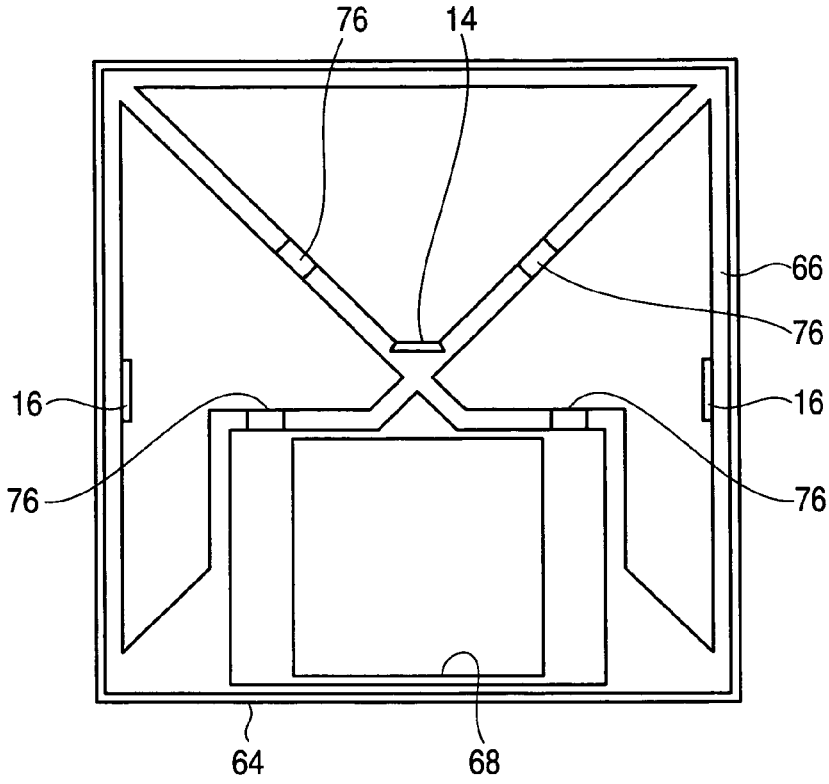
FIG. 33 is a plan view of a planar antenna according to an eighteenth embodiment of the invention.

FIG. 33 shows an eighteenth embodiment of the invention. Here, the same members as those shown in FIG. 29 are denoted by the same reference numerals, and the repetitive description will be omitted. In this case, chip capacitors 76 are interposed in the gaps 70 that are provided in the cross-shaped portion of the radiating electrode 66 shown in FIG. 29. With this configuration, a coupling capacity can be arbitrarily set, and the low resonance frequency can arbitrarily shifted so as to close to the high resonance frequency, which improves the characteristics of the high resonance frequency.

Figure 34:
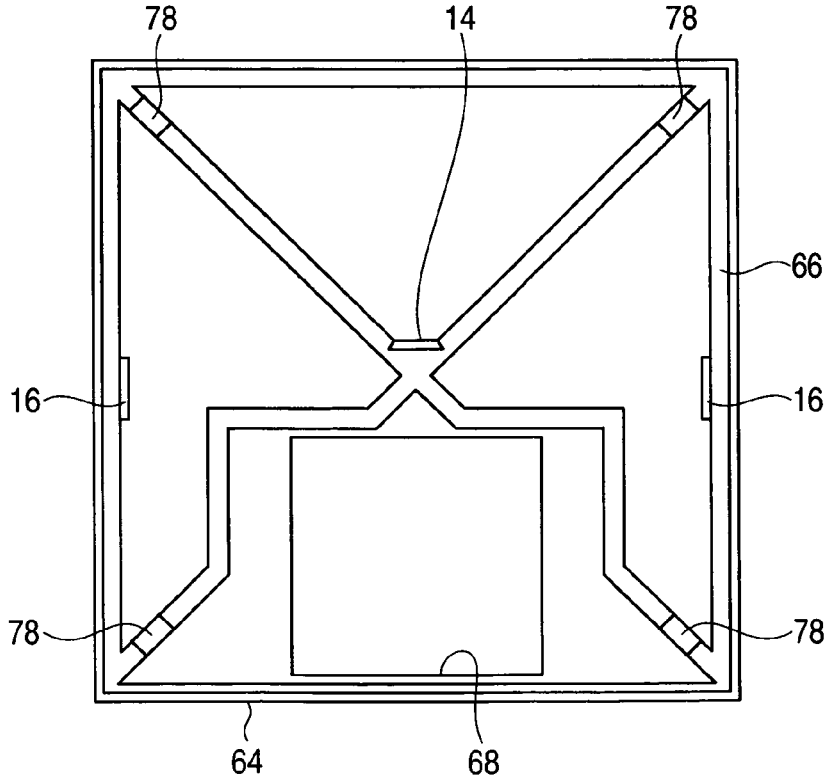
FIG. 34 is a plan view of a planar antenna according to a nineteenth embodiment of the invention.

FIG. 34 shows a nineteenth embodiment of the invention. Here, the same members as those shown in FIG. 29 are denoted by the same reference numerals, and the repetitive description will be omitted. In this embodiment, conductive members of the cross-shaped portions of the radiating electrode 66 are cut at the locations close to the corner portions so as to form the gaps, and chip inductors 78 are interposed in the gaps. With this configuration, the chip inductors 78 serve as extension coils, and thus it is possible to obtain an effect of decreasing the high resonance frequency. Accordingly, it is possible to obtain the same effect as that in the case where the meander elements are interposed at the locations where the chip inductors 78 are interposed. In order to most effectively achieve the function of the chip inductors 78 as the extension coils, the chip inductors are preferably provided at the locations where the maximum current flows in the resonance operation at the high resonance frequency.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosures of Japanese Patent Application Nos. 2006-13684 filed Jan. 23, 2006 and 2007-10047 filed Jan. 19, 2007 including specifications, drawings and claims are incorporated herein by reference in their entirety.

What is claimed is:

1. A planar antenna, comprising:

a plate member adapted to be electrically grounded;

a radiating electrode disposed opposing the plate member with a gap therebetween and extending parallel to the plate member;

a feeding pin disposed at a center part of the radiating electrode and adapted to feed power to the radiating electrode; and at least one pair of short pins electrically connecting the plate member and an outer edge of the radiating electrode at symmetrical positions relative to the feeding pin, wherein the radiating electrode is formed with blank portions which are located at such positions that are on hypothetical straight lines connecting the feeding pin and the short pins, each of the blank portions having a vertex directed to a center portion of the radiating electrode.

2. The planar antenna as set forth in claim 1, wherein:

only one pair of short pins is provided.

3. The planar antenna as set forth in claim 1, wherein:

the radiation electrode is a square conductive plate formed with four triangular blank portions;

one of vertexes of each of the triangular blank portions opposes the feeding pin and the other vertexes thereof oppose corners of the square conductive plate; and the short pins are disposed on intermediate portions of two opposing sides of the square conductive plate.

4. The planar antenna as set forth in claim 1, wherein:

the radiation electrode is a circular conductive plate formed with four fan-shaped blank portions;

a vertex of each of the fan-shaped blank portions opposes the feeding pin and an arcuate portion thereof opposes an outer periphery of the circular conductive plate; and the short pins are disposed on positions opposing arcuate portions of opposing ones of the fan-shaped blank portions.

5. The planar antenna as set forth in claim 1, further comprising:

an additional antenna disposed on the plate member so as to oppose one of the blank portions.

6. The planar antenna as set forth in claim 1, wherein:

portions of the radiating electrode defined between the blank portions are partially cut to form gaps.

7. The planar antenna as set forth in claim 6, further comprising:

chip capacitors, respectively disposed in the gaps.

8. The planar antenna as set forth in claim 6, further comprising:

chip inductors, respectively disposed in the gaps.

9. A planar antenna, comprising:

a plate member adapted to be electrically grounded;

a radiating electrode disposed opposing the plate member with a gap therebetween and extending parallel to the plate member;

a feeding pin disposed at a center part of the radiating electrode and adapted to feed power to the radiating electrode; and at least one pair of short pins electrically connecting the plate member and an outer edge of the radiating electrode at symmetrical positions relative to the feeding pin, wherein the radiating electrode is formed as a square conductive plate with four triangular blank portions which are located at such positions that are on hypothetical straight lines connecting the feeding pin and the short pins, wherein a vertex of each of the four triangular blank portions opposes the feeding pin and the other vertexes thereof oppose corners of the square conductive plate, and wherein the short pins are disposed on intermediate portions of two opposing sides of the square conductive plate.

10. The planar antenna as set forth in claim 9, wherein only one pair of short pins is provided.

11. The planar antenna as set forth in claim 9, further comprising an additional antenna disposed on the plate member so as to oppose one of the blank portions.

12. The planar antenna as set forth in claim 9, wherein portions of the radiating electrode defined between the blank portions are partially cut to form gaps.

13. The planar antenna as set forth in claim 12, further comprising chip capacitors respectively disposed in the gaps.

14. The planar antenna as set forth in claim 12, further comprising chip inductors respectively disposed in the gaps.

15. A planar antenna, comprising:

a plate member adapted to be electrically grounded;

a radiating electrode disposed opposing the plate member with a gap therebetween and extending parallel to the plate member;

a feeding pin disposed at a center part of the radiating electrode and adapted to feed power to the radiating electrode; and at least one pair of short pins electrically connecting the plate member and an outer edge of the radiating electrode at symmetrical positions relative to the feeding pin, wherein the radiating electrode is formed as a circular conductive plate with four fan-shaped blank portions which are located at such positions that are on hypothetical straight lines connecting the feeding pin and the short pins, wherein a vertex of each of the fan-shaped blank portions opposes the feeding pin and an arcuate portion thereof opposes an outer periphery of the circular conductive plate, and wherein the short pins are disposed on positions opposing arcuate portions of opposing ones of the fan-shaped blank portions.

16. The planar antenna as set forth in claim 15, wherein only one pair of short pins is provided.

17. The planar antenna as set forth in claim 15, further comprising an additional antenna disposed on the plate member so as to oppose one of the blank portions.

18. The planar antenna as set forth in claim 15, wherein portions of the radiating electrode defined between the blank portions are partially cut to form gaps.

19. The planar antenna as set forth in claim 18, further comprising chip capacitors respectively disposed in the gaps.

20. The planar antenna as set forth in claim 18, further comprising chip inductors respectively disposed in the gaps.

* * * * *